United States Patent [19]

Husges et al.

[11] 4,232,508

[45] Nov. 11, 1980

[54] KNOTTING MECHANISM PROVIDED WITH A DRIVING MECHANISM

[75] Inventors: Gerd Husges; Rupert Karl, both of Ingolstadt, Fed. Rep. of Germany

[73] Assignee: Schubert & Salzer, Ingolstadt, Fed. Rep. of Germany

[21] Appl. No.: 5,504

[22] Filed: Jan. 22, 1979

[30] Foreign Application Priority Data

Jan. 24, 1978 [DE] Fed. Rep. of Germany ..... 2802886

[51] Int. Cl.[3] ..... D01H 15/02; D01H 15/00

[52] U.S. Cl. ..... 57/22; 57/263

[58] Field of Search ..... 57/22, 263, 262, 80; 242/35.5 R, 35.5 A

[56] References Cited

U.S. PATENT DOCUMENTS

| | | | |
|---|---|---|---|
| 3,540,200 | 11/1970 | Tsukumo et al. | 57/262 |
| 3,858,385 | 1/1975 | Shinkai et al. | 57/263 |
| 4,121,409 | 10/1978 | Uchida et al. | 57/22 |
| 4,150,532 | 4/1979 | Ligonés | 57/263 |

*Primary Examiner*—Donald Watkins

*Attorney, Agent, or Firm*—Bailey, Dority & Flint

[57] ABSTRACT

A knotting mechanism for use on open-end spinning machines for performing a knotting process on yarn produced on machines. The knotting mechanism is mounted so that it can be moved longitudinally along the spinning machine and transversely to the spinning machine to a knotting position. A switch-on mechanism is activated responsive to the knotting mechanism being moved transversely to the spinning machine to a knotting position. A driving mechanism is provided for initiating the knotting process on the yarn upon being activated. A release mechanism is operably connected to the driving mechanism for activating the driving mechanism responsive to the switch-on mechanism being activated. A timing device de-activates the driving mechanism after a predetermined period of time sufficient to carry out the knotting process and prevents the driving mechanism from initiating another knotting process without the switch-on mechanism being further de-activated and re-activated. Both electro-mechanical and mechanical mechanisms are provided for insuring that only a single knotting process is performed while the knotting mechanism is in the region of the yarn that is to be knotted.

11 Claims, 6 Drawing Figures

KNOTTING MECHANISM PROVIDED WITH A DRIVING MECHANISM

BACKGROUND OF THE INVENTION

The present invention refers to a knotting mechanism which is provided with a driving mechanism and which is arranged in a mounting which can travel along an open-end spinning machine and in addition can move transversely to the open-end spinning machine.

The idea is already known, of providing in a carriage which can travel along an open-end spinning machine with a knotting mechanism which can swing transversely to the open-end spinning machine (East German Pat. No. 82.079). In this case, it is necessary to match the time during which the knotting mechanism is lying in the region of the yarn to be knotted, exactly to the time of the knotting process. But in practice this is not possible or only possible with very great difficulty since the knotting takes place extraordinarily rapidly and needs only a fraction of a second. While the exact matching of the in-swing time to the knotting time already causes difficulties in the case of automatic swinging mechanisms, this matching in the case of manual swinging of the knotting mechanism is by far more difficult to achieve.

SUMMARY OF THE INVENTION

This problem is solved in accordance with the invention by providing the knotting mechanism with a switching-on mechanism which can be actuated in dependence upon the motion transversely to the open-end spinning machine. It is also provided with a release mechanism for the driving mechanism and with which is connected a timing element which is matched to the operating time of the knotting mechanism and which can be brought into action upon a controllable blocking device for the release mechanism. The knotting process gets triggered from the switching-on mechanism by release of the driving mechanism. In order that later in spite of the switching-on mechanism still being actuated, the driving mechanism can be brought to rest again or separated from the knotting mechanism, the release of the driving mechanism is not effected by the switching-on mechanism directly, but by a release mechanism which can be actuated by the switching-on mechanism. For establishing the instant of bringing to rest the knotting mechanism, simultaneously with the actuation of the driving mechanism a timing element matched to the knotting time is switched on, which acts upon a blocking device for the release mechanism and via this release mechanism brings the driving mechanism to rest or separates it from the knotting mechanism. The blocking device remains in its blocking position until it is released again. Preferably this happens in combination with a transverse motion of the knotting mechanism since in this case the switching-on mechanism gets released too, whereby the release mechanism remains in its blocking position. In the case of a fresh actuation of the release mechanism the release mechanism can now release the driving mechanism again so that another knotting process may be performed.

Because the release lever becomes cocked, for further release of the knotting mechanism after performance of a knotting cycle, repeated knotting is prevented with certainty. Hence it is possible to entrust even unskilled personnel with attending to the knotting mechanism.

Although in principle it is possible to drive the knotting mechanism directly by a motor, e.g., a stepping motor, it is advantageous if the driving mechanism exhibits a controllable coupling over which the drive of the knotting mechanism is controlled. In accordance with a preferred embodiment of the invention, the driving mechanism exhibits a spiral coupling which is arranged between a continuously driven hollow cylinder and a shaft which drives the knotting mechanism. Upon release of the spiral coupling it lies against the inside of the hollow cylinder and one end of the spiral coupling is secured in the shaft and the other end includes a section which is arranged outside the hollow cylinder and projects radially outwards into engagement with a release mechanism. The release mechanism is under the action of a timing element and a retainer edge of a release lever forming the release mechanism can be brought and can be held in this position under the action of a blocking-device until being released by a control mechanism. In accordance with a simple embodiment of the invention the timing element is made as a switch cam. The blocking-device can in that case exhibit a blocking lever which bears against the switch cam which can be brought into action upon by the release lever and can be held in this blocking position by a locking device. In this case, the locking device is advantageously made as a pawl. Since it is as a rule necessary to move the knotting mechanism away from the open-end spinning machine between two knotting processes, it is particularly advantageous if there is associated with the pawl a control mechanism. The control mechanism can be actuated in dependence upon the transverse motion of the knotting mechanism. This is possible in a simple way if the mounting has a carriage which can travel along the spinning machine and to which is hinged a swinging arm. In this case, the control mechanism can be actuated in dependence upon the position of the swinging arm relative to the carriage. If the locking device is made as a pawl, the carriage may exhibit between the hingepoint of the swinging arm and the pawl a point of attachment for a flexible actuator member connected to the pawl, in the region of which close to the hingepoint of the swinging arm the latter exhibits on the side of it next to the carriage a deflector-pin for the actuator member.

In order to be able to switch off the driving mechanism in a simple way when not needed, the driving mechanism advantageously exhibits a motor carried by the swinging arm and the carriage exhibits a switching member for a switch. The switch is arranged in the swinging arm and is arranged in the circuit to the motor. In this way every time that the swinging arm is swung away from the open-end spinning machine the motor is switched off.

Since always independently of the time during which the knotting mechanism is lying in the region of the yarn to be knotted only one single knotting cycle is made possible, faulty operation of the knotting mechanism is avoided with certainty. In this way there is achieved a simplification of automatically actuable knotting mechanisms and the prerequisite created for working with the aid of knotting mechanisms which can be brought manually into the working region.

It is an object of the present invention to provide a mechanism which guarantees that a knotting mechanism executes only a single knotting process independently of how long it is lying in the region of the yarn to be knotted.

Another important object of the present invention is to provide a relatively simple and reliable system for insuring only a single knotting operation being executed on yarn when joining ends thereof or removing imperfections therein.

These and other objects and advantages of the invention will become apparent upon reference to the following specification, attendant claims and drawings.

DESCRIPTION OF A PREFERRED EMBODIMENT

Figure 1:
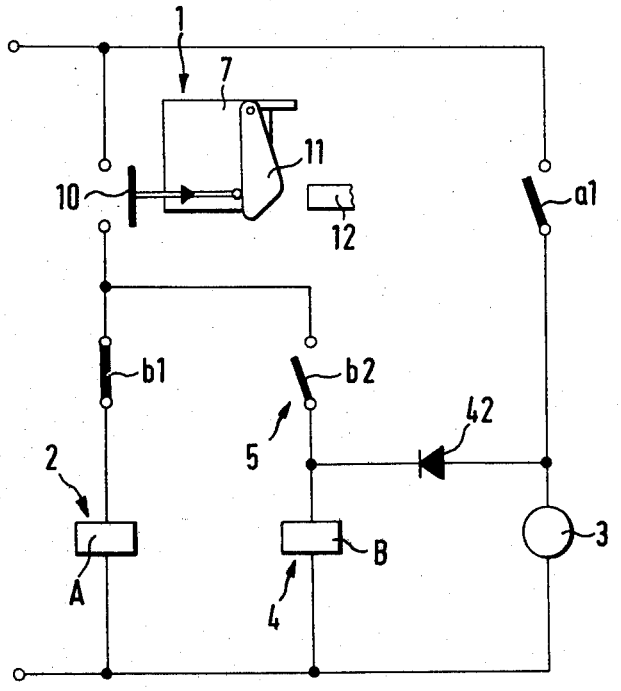
FIG. 1 is an electrical circuit diagram constructed in accordance with the present invention which shows that only a single knotting operation occurs when a knotting mechanism is moved into a knotting position.

In FIG. 1 the principle of the mechanism in accordance with the invention is explained with the aid of an electrical circuit diagram. A release mechanism 2 is connected to an electrical power supply via a switching-on mechanism 1. The switching-on mechanism 1 exhibits a switch 10 which can be closed by a switching-on lever 11 running up against a stop 12 arranged at the spinning unit on an open-end spinning machine. The release mechanism 2 includes a relay A having a normally-open contact a1 in a circuit of which includes a driving mechanism 3, in which case the driving mechanism 3 may be a motor or a coupling which connects a motor to a knotting mechanism 7. In series with the contact a1 but in parallel with the driving mechanism 3 is a timing element 4 which includes a relay B having a normally-closed contact b1 in the circuit of the relay A. A second normally-open contact b2 of relay B is provided in a connecting lead between the switch 10 and the relay B and acts as a blocking device 5.

Since the knotting process as such is known, the description of the knotting process, the path of the yarn and the laying of the yarn into the knotting mechanism brought up to the spinning station is omitted. The knotting mechanism 7 travels in known manner along the open-end spinning machine and is brought to the spinning unit at which a knotting process is to be performed. In a suitable way, e.g., by swinging about an axis or sliding in guides, the knotting mechanism 7 is moved transversely to the machine and brought close to the spinning unit and the path of the yarn, whereby the yarn gets laid into the knotting mechanism 7. Simultaneously the switching-on lever 11 runs up against the stop 12. The switch 10 is thereby closed and the relay A excites the release mechanism 2 via the closed contact b1. The relay A closes its contact a1 whereby the driving mechanism 3 is actuated and the relay B of the time element 4 is excited, which after the expiry of a certain period of time matched to the knotting cycle opens the contact b1. Thereupon the relay A drops out, which now opens its contact a1 again. In this way the current feed to the driving mechanism 3 is blocked so that the knotting mechanism 7 is brought to rest. Simultaneously with the opening of the contact b1 the relay B of the time element 4 has however closed its contact b2 acting as blocking device 5, so that it holds itself in the excited position. A diode 42 prevents switching-on of the driving mechanism with the contact b2 closed and the contact a1 open. The relay B remains energized as long as the switch 10 remains closed. But the current supply via contact b1 to the relay A and the current supply to the driving mechanism 3 via contact a1 thereby remains interrupted, so that without new actuation of the switch 10, a further knotting cycle is not possible.

Figure 2:
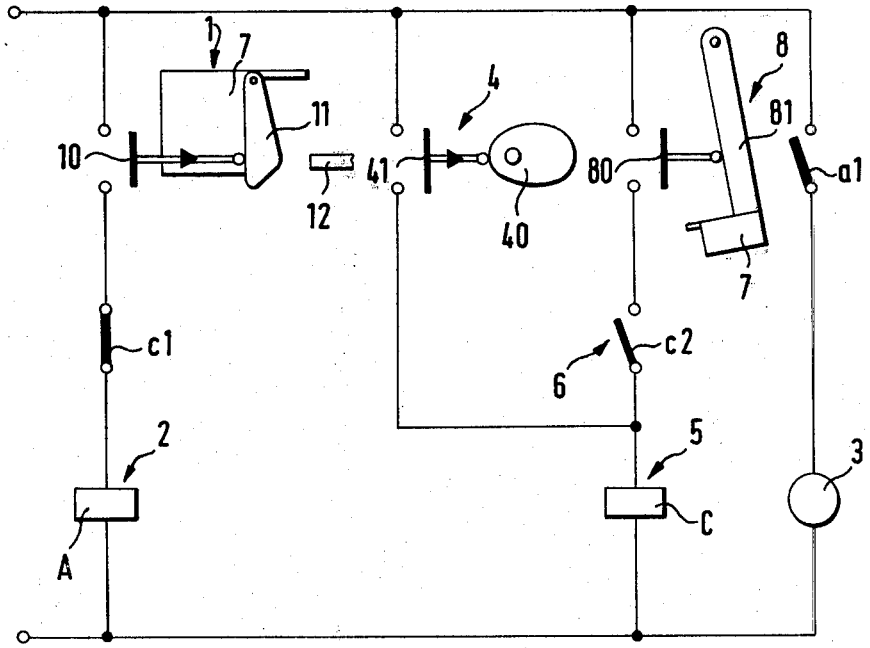
FIG. 2 is a modified form of the invention illustrated in schematic form of an electro-mechanical device for insuring only a single knotting operation by a knotting machine.

FIG. 2 shows a modification of the mechanism shown in FIG. 1 in which the timing element 4 is not a relay but a switch cam 40 driven by the driving mechanism 3 which is made use of, which cooperates with a switch 41. The blocking device 5 with which is associated an additional locking mechanism 6 is in that case again not made as a contact but as a relay C. This blocking device 5 is moreover controlled not by the switching-on mechanism 1 but by a separate control mechanism 8. The control mechanism 8 exhibits a switch 80 which is actuated by a swinging arm 81 in dependence upon its position of swing.

In the case of this device, the driving mechanism 3 is switched on via a switching-on mechanism 1 and the release mechanism 2 actuated by it, whereby the switch cam 40 of the timing element 4 is also set in rotation. After an angle of rotation matched to the knotting cycle, the switching cam 40 closes the switch 41, causing the blocking device 5 to be energized which blocks the release mechanism 2 by interruption of the current supply (opening of c1) and holds itself in by the locking mechanism 6. The relay C of the blocking device 5 is arranged in a circuit parallel with the contact a1 and the driving mechanism 3. In this parallel circuit, in series with the relay C there is arranged a normally-open contact c2 and the said control mechanism 8. The locking mechanism 6 is in that case formed by the contact c2. The relay C has further a normally-closed contact c1 in the circuit of the relay A, in which case the contact c1 replaces the contact b1 of FIG. 1.

Since the switching-on mechanism can only be actuated if the knotting mechanism 7 is lying in the region of the stop 12 and hence in the swung-in state, the switch 80 is also actuated by the swinging arm 81 which carries the knotting mechanism 7. In the case of small swinging movements of the swinging arm 81 it is indeed possible to actuate the switching-on lever 11 a number of times; but since the switch 80 is opened only in the case of larger swings, the blocking device 5 remains locked. But if the switch 80 is released by a larger swinging motion the relay C of the blocking device 5 drops out whereby the contact c2 forming the locking mechanism 6 opens and the contact c1 closes. By closing of the contact c1 it is possible by actuation of the switching-on mechanism 1 to trigger another knotting cycle.

Figure 3:
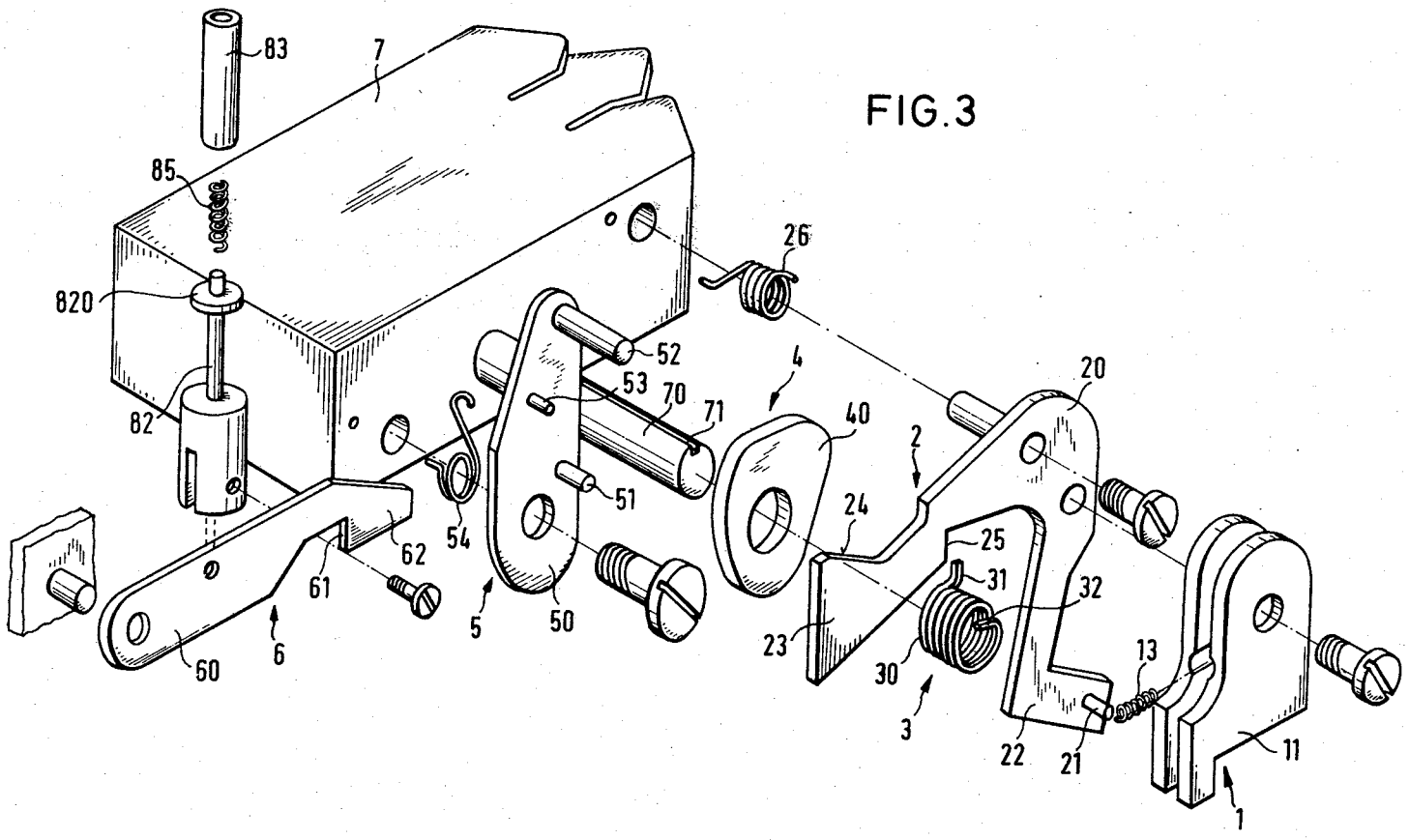
FIG. 3 is an exploded perspective view illustrating another modified form of the invention wherein the operation of the knotting mechanism is controlled mechanically.
Figure 4:
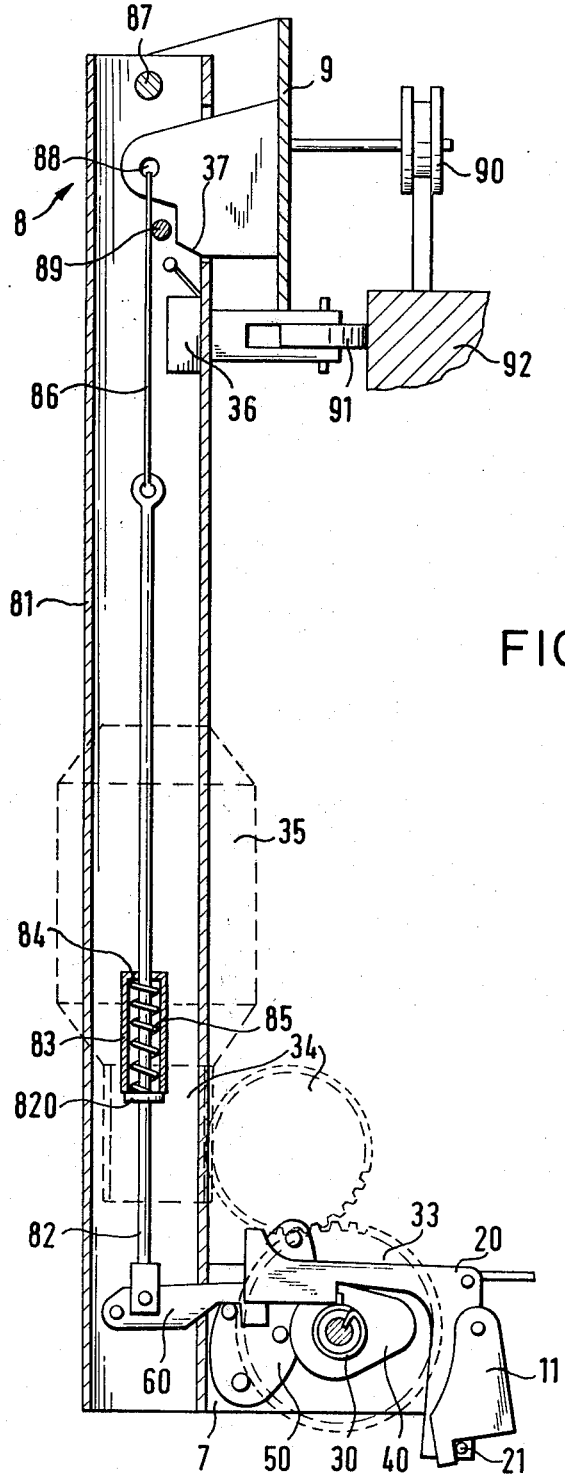
FIG. 4 is a side elevational view partially in section illustrating a mounting for the mechanism of FIG. 3.

FIGS. 3 and 4 show a modification of the invention in which the electrical members have been replaced by mechanical members. A switching-on lever 11 is again provided, which is supported on a release lever 20 forming the release mechanism 2 and bears resiliently by means of a compression spring 13 against this release lever 20. The relative stroke of the switching-on lever 11 with respect to the release lever 20 is limited by steps 21 on the arm 22 of the release lever 20, bearing the switching-on lever 11. The release lever 20 is supported on the knotting mechanism 7 and exhibits at an angle to the arm 22 a second arm 23 with a run-up ramp 24 at its outer end, the purpose of which will be explained in greater detail later. On the inside the arm 23 exhibits a retainer edge 25 with which cooperates a radially projecting section 31 of a spiral coupling 30 belonging to the driving mechanism 3. By a torsion spring 26 associated with the release lever 20, which bears at one end against the knotting mechanism 7 and at the other end against the release lever 20, the arm 23 is held by its retainer edge always in the region of the section 31 of the spiral coupling 30. The spiral coupling 30 is seated on the shaft 70 of the knotting mechanism 7 and exhibits a longitudinal groove 71 for receiving the other end 32 of the spiral coupling 30.

On the shaft 70 is seated by means of ball bearings (not shown) and the spiral coupling 30, a driving gear wheel 33 which with the spiral coupling 30 relaxed is connected to the shaft 70 but with the spiral coupling 30 stressed turns freely on the shaft 70 by means of the ball bearings. The driving gear wheel is connected via a gear 34 to a driving motor 35.

The switch cam 40 arranged on the shaft 70 is used as the timing element as already mentioned in connection with FIG. 2. The switch cam 40 cooperates with a pin 51 of a blocking mechanism 5 made as a blocking lever 50, which is fastened to the knotting mechanism 7 and is held in contact with the switch cam 40 by a torsion spring 54 bearing against the knotting mechanism 7 and the blocking lever 50. At the end of it the blocking lever 50 carries a further pin 52 which cooperates with the arm 23 and in particular with the run-up ramp 24 of the release lever 20. The blocking lever 50 carries yet a third pin 53 with which cooperates a locking mechanism 6. In the embodiment shown, the locking mechanism 6 is made as a pawl 60 which is supported in the swinging arm 81. For cooperation with the pin 53 the pawl 60 exhibits a retainer edge 61. A rod 82 is connected to the pawl 60 as actuator member, which is guided by a sleeve 82 connected to the swinging arm 81. The sleeve exhibits at its top end a shoulder 84 against which bears a compression spring 85. The other end of the compression spring 85 bears against a set collar 820 on the rod 82. The rod is connected via a cord 86 to a carriage 9 which by means of wheels 90 and 91 can be traversed along the open-end spinning machine 92. The swinging arm 81 is hinged to the carriage 9 at a first pivot point 87, while the cord 86 is fastened to the carriage 9 at a point 88 which lies between the pawl 60 and the pivot point 87. At the side of the cord 86 next to the carriage 9 there is on the swinging arm 81 a deflector-pin 89.

In the state of the swinging arm 81 swung away from the carriage 9 the cord 86 is deflected by the deflector pin 89 and hence the pawl 60 is raised against the action of the compression spring 85 so that the blocking lever 50 is released and rests against the switch cam 40. In this position of swing the knotting mechanism 7 is traversed by means of the carriage 9 along the open-end spinning machine to the spinning unit at which in joining the yarn afresh or in eliminating a yarn breakage a join is to be eliminated by a knot. At the spinning unit the carriage 9 is arrested in the correct position by means not shown and is now swung in the direction towards the spinning unit and hence towards the stop 12 (FIGS. 1 and 2). The deflector pin 89 releases the cord 86 again so that the pawl 60 under the action of the compression spring 85 rests by its end 62 against the pin 53. When the switching-on lever 11 of the switching-on mechanism 1 runs up against the stop 12, the switching-on lever is pivoted clockwise. The compression spring 13 is stronger than the torsion spring 26 so that the pivotal movement of the switching-on lever 11 is transmitted to the release lever 20 of the release mechanism 2. Due to this the retainer edge 25 now releases the section 31 and hence the spiral coupling 30 of the drive mechanism 3, which is now relaxed and rests from the inside against the driving gear wheel 33 forming a hollow cylinder, which is driven continuously by the driving motor 35 via the gear 34. Due to this the shaft 70 of the knotting mechanism 7 is also now driven by the driving gear wheel 33 via the spiral coupling 30, since the spiral coupling 30 is connected via its end 32 to the shaft 70.

But on the shaft 70 there is seated the switch cam 40 acting as the timing element 4, which now likewise gets driven. With its turning the switch cam 40 via the pin 51 finally pivots the blocking lever 50 forming the blocking device 5 counter-clockwise, whereby the pin 52 engages with the run-up ramp 24 of the release lever 20 and forces this release lever 20 with its retainer edge 25 into the region of the radial section 31 of the spiral coupling 30 revolving with the shaft 70. This pivotal travel of the release lever 20 is made possible with the position of the switching-on lever 11 unchanged because the compression spring 13 takes up this travel. When this section 31 with further turning of the shaft 70 runs up against the retainer edge 25, by holding back the section 31 the spiral coupling 30 becomes stressed, whereby its diameter is reduced and it is released from the inner periphery of the driving gear wheel 33 and whereby the driving connection between the driving motor 35 and the knotting mechanism 7 is interrupted. The switch cam 40 has meanwhile also released the pin 51 of the blocking lever 50. But the blocking lever 50 cannot follow the switch cam 40 since at the instant of the deflection of the blocking lever 50 the pawl 60 of the locking mechanism 6 pre-stressed by the compression spring 85 is caught behind the pin 53 and holds the blocking lever 50 in the deflected position.

Hence the time of actuation or the number of actuations of the switching-on lever 11 plays no part in the actuation of the knotting mechanism as long as the blocking device 5 is not released. But this is the case only when the swinging arm 81 with the knotting mechanism 7 gets swung away from the spinning unit far enough for the deflector pin 89 to raise the pawl 60 again via the cord 86, so that under the action of the torsion spring 54 the blocking lever 50 again rests by its pin 51 against the switch cam 40.

In order to prevent the driving motor 35 from working in the position where the swinging arm 81 is swung away from the spinning units, a switch 36 is advantageously provided in the swinging arm 81, with which is associated a switch cam 37 fastened to the carriage 9. In its position swung away from the spinning units, the switch cam 37 releases the switch 36 whereby the current supply to the driving motor 35 is cut off. When on the contrary the swinging arm 81 is swung in the direction towards a spinning unit for knotting, the switch cam 37 actuates the switch 36 whereby the driving motor 35 is also switched on. In this way the driving motor 35 gets driven only for the time that the knotting mechanism 7 is lying in the correct position of swing for knotting.

Figure 5:
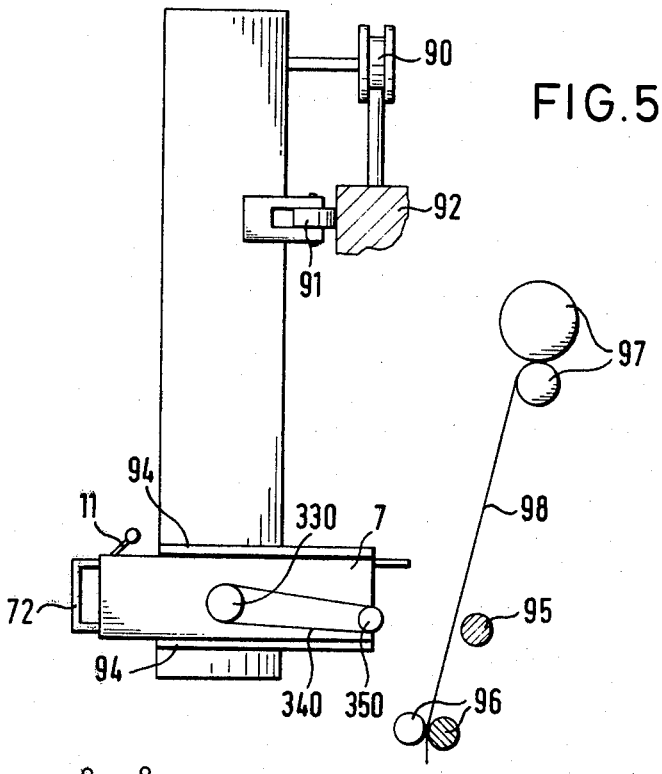
FIG. 5 is a side elevational view of still another modified form of the invention.

FIG. 5 shows a modification of the invention in which a knotting mechanism 7 made as a slide is arranged in guide rails 94 in a carriage 93 without a swingable arm.

The switching-on mechanism may be made in the way described previously. But it is also possible to provide the switching-on lever 11 on the knotting mechanism 7 made as a slide, and it then acts electrically (FIG. 1 or 2) or mechanically on a release mechanism 2.

For the drive a special motor does not absolutely have to be used. For example, a driving wheel 330 made as a hollow cylinder, which can be connected drivewise by a suitable coupling to the shaft 70 of the knotting mechanism 7 (FIGS. 3 and 4), can be connected by a driving connection 340 to a friction wheel 350 which in the working position of the knotting mechanism 7 rests against a constantly driven shaft 95 of the open-end spinning machine.

Hence, in the working position of the knotting mechanism 7 into which it can be pushed by means of a handle 72 fastened to the knotting mechanism 7, the drive wheel 330 is driven continuously.

As FIG. 5 shows clearly, the knotting mechanism 7 is as a rule brought into the region of the yarn 98 between the draw-off rolls 96 of the open-end spinning machine and its spooling device 97. But if the knotting mechanism 7 should for any reason whatever be brought into the run of the yarn 98 between the spinning member (not shown) and the draw-off rolls 96, even this does not prejudice the object of the invention.

The mechanism of the invention may be modified in many ways. Thus the knotting mechanism 7 may be brought into the working position by swinging (FIGS. 3 and 4) or sliding (FIG. 5). Correspondingly the switching-on mechanism 1 too may be actuated by a stop 12 at the spinning unit (FIGS. 1 and 2) or by the carriage 93 (FIG. 5).

The mechanism in accordance with the invention may be controlled mechanically (FIGS. 3 and 4), electrically (FIGS. 1 and 2) or in some other way. Combinations of these are possible too, as is explained below with the aid of FIG. 6.

In the case of this embodiment, the switching-on mechanism 1, the release mechanism 2, the driving mechanism 3 and the timing element 4 are unaltered as compared with the embodiment shown in FIGS. 3 and 4. But the blocking device 5 consists in this case of a switch 55 which can be actuated by the switch cam 40, as well as an electro-magnet 56 controlled from the switch 55, the core 57 of which exhibits a bent-over end 58 which cooperates with the run-up ramp 24 of the arm 23 of the release lever 20. By a switch 74 actuable by a lever 73, arranged in the handle 72 of the knotting mechanism 7 or respectively of the swinging arm 81 of a relay 63 is actuated, which acts as the locking mechanism 6, its contact 64 bridging across the switch 55.

Instead of the blocking lever 50 (FIGS. 3 and 4), with the turning of the switch cam 40 the switch 55 is now actuated, which via the electro-magnet 56 pivots the release lever 20 towards the shaft 70 by the end 58 of its core 57, so that the retainer edge 25 with further turning of the shaft 70 catches the section 31 of the spiral coupling 30 and by stressing of the spiral coupling 30 removes the driving connection between the driving gear wheel 33 and the shaft 70.

With the swinging or sliding of the knotting mechanism 7 the operator of the machine has actuated a switch 74 via a lever 73. Via the now closed switch 55 and via the likewise closed switch 74 the relay 63 is now excited, which now closes its contact 64 and holds itself in by it as long as the switch 74 remains closed. When upon removal of the knotting mechanism 7 from the spinning unit the switch 74 is released, the relay 63 and the electro-magnet 56 drop out too. But through the switching-on lever 11 being meanwhile released, the release lever 20 can follow the action of the torsion spring 26 and remain furthermore in the position in which its retainer edge 25 secures the section 31 of the spiral coupling 30.

Figure 6:
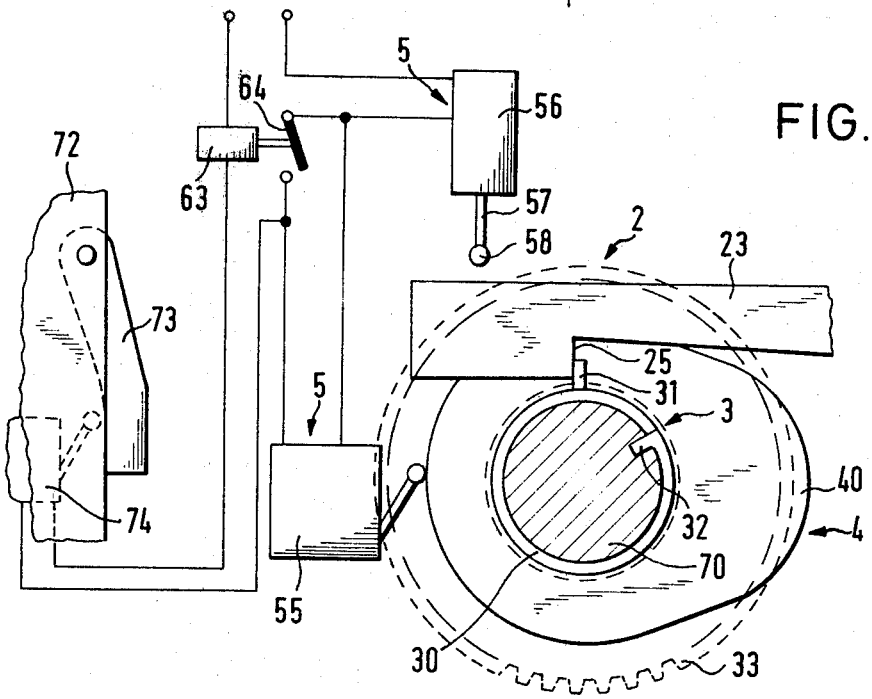
FIG. 6 is a side elevational view of an electromechanical device constructed in accordance with the present invention for controlling the operation of a knotting mechanism.

Instead of a switch 73 in the handle 72 a switch may also be arranged in the swinging arm 81. For example, the switch 36 (FIG. 4) serves this purpose, which otherwise controls the driving motor 35. Further modifications of the invention are possible. Thus, instead of a mechanical coupling (e.g., a spiral coupling) an electrically-operated coupling may be provided too. Also the driving gear wheel 33 or the driving wheel 330 may be replaced by a hollow shaft or a shaft having a hollow end connected to a drive. In the case of locking mechanism made as a pawl 60 it is possible to control it by means of an electro-magnet (not shown) which is subject to the action of a switch (e.g., 73 (FIG. 6—or 36 FIG. 4). If the control is effected mechanically via a resilient actuator member, this may be made apart from as a cord 86 also in some other way, e.g. as a chain.

While a preferred embodiment of the invention has been described using specific terms, such description is for illustrative purposes only, and it is to be understood that changes and variations may be made without departing from the spirit or scope of the following claims.

What is claimed is:

1. A knotting mechanism for use on an open end spinning machine for performing a knotting process on yarn being produced on said spinning machine, mounting means for supporting said knotting mechanism so as to permit said knotting mechanism to be moved along said spinning machine and transversely to said spinning machine to a knotting position, said knotting mechanism comprising:

a switching-on mechanism (1);

means for activating said switch-on (1) mechanism responsive to said knotting mechanism being moved transversely to said knotting position;

driving means (3) for initiating said knotting process on said yarn upon being activated;

a release means (2) operably connected to said driving means (3) for activating said driving means responsive to said switch-on mechanism (1) being activated;

timing means (4) for de-activating said driving means after a predetermined period of time sufficient to carry out said knotting process and for preventing said driving means from initiating another knotting process without first de-activating and re-activating said switch-on (1) mechanism.

2. A knotting mechanism, mounting means supporting said knotting mechanism for travel along an open-end spinning machine and for movement rransversely to said open-end spinning machine, and driving means for selectively initiating a knotting process on yarn being produced upon being activated, comprising:

a switching-on means (1) for said knotting mechanism (7) which is actuated in dependence upon said transverse motion of said knotting mechanism;

a release means (2, a1) operably connected to said driving means (3) for activating said driving means when actuated responsive to said switch-on means being activated;

a timing means (4) de-activating said driving mechanism after a predetermined period of time sufficient to carry out said knotting process, and a blocking means (5) operably connected to said timing means (4) preventing said driving means from initiating another knotting process without said switch-on means (1) being further de-activated and re-activated.

3. The knotting mechanism as set forth in claim 2 further comprising:

said blocking means (5) is controlled in dependence upon said transverse motion of said knotting mechanism.

4. The knotting mechanism as set forth in claim 3 further comprising:

said driving means including:

(i) a continuously driven hollow cylinder (33), (ii) a shaft (70) for driving said knotting mechanism (7), (iii) a spiral coupling (3) carried on said shaft with a portion inside said hollow shaft, (iv) one end of said coupling (3) being secured to said shaft (70) and the other end forming a section (31) which is arranged outside said hollow cylinder (33, 330) and projecting radially (v) said coupling (3) when in a released state lies against the inside of said hollow cylinder coupling said hollow cylinder (33) to said shaft (70), said release means including:

(i) a release lever 20 having a retainer edge (25), said blocking means causing said other end of said coupling (3) to come into engagement with said retainer edge which under the action of said timing means (4), said retainer edge (25) of said release lever (2) is brought into contact with said other end of said coupling (3) holding said coupling in said release state.

5. The mechanism as set forth in claim 4 further comprising:

said timing means includes a switch cam (40).

6. The mechanism as set forth in claim 5 further comprising:

said blocking means includes, (i) a blocking-lever (50) which bears against said switch cam (40), (ii) means for rotating said switch cam (40) allowing said blocking-lever (50) to engage said release lever (20) causing said coupling (3) to come out of said release state, and (iii) a locking device (6) engaging said blocking lever (50) holding said coupling out said release state.

7. The mechanism as set forth in claim 6 further comprising:

said locking device is a spring biased pawl (60).

8. The mechanism as set forth in claim 7 further comprising:

a control means (88, 86, 89, 36, 11) connected to said pawl for manipulating said pawl (60) responsive to said transverse motion of said knotting mechanism (7).

9. The mechanism as set forth in claim 8 further comprising:

said mounting means including:

(i) a carriage means (9) for traveling along said open-end spinning machine, (ii) a swinging arm (81) hinged to said carriage (9), and said control mechanism (88, 86, 89, 90, 36) being actuated in dependence upon the position of said swinging arm relative to said carriage (9).

10. The mechanism as set forth in claim 9 further comprising:

said control mechanism including:

(i) a flexible actuator member (86) connected between said pawl (60) and a point of attachment (88) carried on said carriage (9) adjacent a hinge point (87) for said swinging arm, and (ii) a deflector means (89) for engaging said actuator member (86).

11. The mechanism as set forth in claim 10 further comprising:

said driving means including:

(i) a motor (35) carried by said swinging arm (81), a switch (80, 36) carried by said swinging arm (81) and electrically connected to a circuit for said motor (35), and a switching member (37) carried by said carriage (9) for operating said switch (80, 36).

* * * * *